US008888959B2

(12) United States Patent
Samuelsson et al.

(10) Patent No.: US 8,888,959 B2
(45) **Date of Patent: *Nov. 18, 2014**

(54) FEEDING SYSTEM COMPRISING PUMPS IN PARALLEL FOR A CONTINUOUS DIGESTER

(71) Applicant: Valmet AB, Sundsvall (SE)

(72) Inventors: Anders Samuelsson, Hammaro (SE); Jonas Saetherasen, Hammaro (SE); Daniel Trolin, Karlstad (SE)

(73) Assignee: Valmet AB, Sundsvall (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/094,840

(22) Filed: Dec. 3, 2013

(65) Prior Publication Data

US 2014/0138039 A1 May 22, 2014

Related U.S. Application Data

(63) Continuation-in-part of application No. 12/933,420, filed as application No. PCT/SE2009/050286 on Mar. 19, 2009, now Pat. No. 8,728,278.

(30) Foreign Application Priority Data

Mar. 20, 2008 (SE) ..... 0800644

(51) Int. Cl.

| | |
|---|---|
| ***D21C 7/06*** | (2006.01) |
| ***D21C 3/24*** | (2006.01) |
| *D21C 1/06* | (2006.01) |

(52) U.S. Cl.
CPC .. *D21C 3/24* (2013.01); *D21C 7/06* (2013.01); *D21C 1/06* (2013.01)
USPC ..... 162/246; 162/243

(58) Field of Classification Search
CPC ..... D21C 7/06; D21C 7/00
USPC ..... 162/243, 246
See application file for complete search history.

(56) References Cited

U.S. PATENT DOCUMENTS

| | | | | |
|---|---|---|---|---|
| 3,303,088 | A | 2/1967 | Gessner | |
| 4,746,404 | A * | 5/1988 | Laakso | 162/232 |
| 5,744,004 | A | 4/1998 | Ekholm | |
| 5,753,075 | A | 5/1998 | Stromberg | |
| 5,968,314 | A | 10/1999 | Prough | |
| 2001/0022283 | A1 | 9/2001 | Bilodeau | |
| 2011/0073266 | A1 * | 3/2011 | Samuelsson et al. | 162/237 |

FOREIGN PATENT DOCUMENTS

| | | |
|---|---|---|
| SE | WO2006101449 | 9/2006 |

* cited by examiner

*Primary Examiner* — Anthony Calandra
(74) *Attorney, Agent, or Firm* — Rolf Fasth; Fasth Law Offices

(57) ABSTRACT

The feed system is for a continuous digester where at least two pumps are arranged in parallel in the bottom of a pretreatment vessel and a liquid level of at least 20 meters is established. The system makes it possible to provide a feed system with an improved accessibility and more reliable operation, and to operate the main part of the pumps at optimal efficiency even if the production capacity is reduced.

7 Claims, 8 Drawing Sheets

FEEDING SYSTEM COMPRISING PUMPS IN PARALLEL FOR A CONTINUOUS DIGESTER

PRIOR APPLICATIONS

This is a continuation-in-part application that claims priority from U.S. patent application Ser. No. 12/933,420, filed 26 Nov. 2010 that claim priority from International Application No. PCT/SE2009/050286, filed 19 Mar. 2009 claiming priority from Swedish Patent Application No. 0800644-7, filed 20 Mar. 2008.

TECHNICAL FIELD

The present invention relates to a feed system for a continuous digester in which wood chips are cooked for the production of cellulose pulp.

BACKGROUND AND SUMMARY OF THE INVENTION

In older conventional feed systems for continuous digesters, high-pressure pocket feeders have been used as sluice feeders for pressurisation and transport of a chips slurry to the top of the digester.

The *Handbook of Pulp*, (Herbert Sixta, 2006) discloses this type of feeding with high-pressure pocket feeders (High-pressure Feeder) on page 381. The big advantage with this type of feed is that the flow of chips does not need to pass through pumps, but is instead transferred hydraulically. At the same time it is possible to maintain a high pressure in the transfer circulation to and from the digester without losing pressure. The system has however demonstrated some disadvantages in that the high-pressure pocket feeder is subjected to wear and must be adjusted so that the leakage flow from the high-pressure circulation to the low-pressure circulation is minimized. Another disadvantage is that during transfer, the temperature must be kept low so that bangs related to steam implosions do not occur in the transfer.

As early as 1957, U.S. Pat. No. 2,803,540 disclosed a feed system for a continuous chip digester where chips are pumped from an impregnation vessel to a digester in which the chips are cooked in a steam atmosphere. Here, a part of the cooking liquor is charged to the pump to obtain a pumpable consistency of 10%. However, this digester was designed for small scale production of 150-300 tons pulp per day (see col. 7, r. 35).

Also, U.S. Pat. No. 2,876,098 from 1959 discloses a feed system for a continuous chip digester without a high-pressure pocket feeder. Here the chips are suspended in a mixer before they are pumped with a pump to the top of the digester. The pump arrangement is provided under the digester and here the pump shaft is also fitted with a turbine in which pressurised black liquor is de-pressurised to reduce the required pump energy.

U.S. Pat. No. 3,303,088 from 1967 also discloses a feed system for a continuous chip digester without a high-pressure pocket feeder, where the wood chips are first steamed in a steaming vessel, followed by suspension of the chips in a vessel, whereafter the chips suspension is pumped to the top of the digester.

U.S. Pat. No. 3,586,600 from 1971 discloses another feed system for a continuous digester mainly designed for finer wood material. Here, a high-pressure pocket feeder is not used either, and the wood material is fed with a pump 26 via an upstream impregnation vessel to the top of the digester.

Similar pumping of finer wood material to the top of a continuous digester is also disclosed in EP157279.

Typical for these embodiments of digestion systems from the late 50's to the beginning of the 70's is that these were designed for small digester houses with a limited capacity of about 100-300 tons pulp per day.

U.S. Pat. No. 5,744,004 discloses a variation of feeding wood chips into a digester where the chip mixture is fed into the digester via a series of pumps. Here, so called DISC-FLO™ pumps are used. A disadvantage with this system is that this type of pump typically has a very low pump efficiency.

The previously mentioned *Handbook of Pulp* also discloses, on page 382, an alternative pump feed of chip mixtures called TurboFeed™. Here three pumps are used in series to feed the chips mixture to the digester. This type of feed has been patented in U.S. Pat. No. 5,753,075, U.S. Pat. No. 6,106,668, U.S. Pat. No. 6,325,890, U.S. Pat. No. 6,336,993 and U.S. Pat. No. 6,551,462; however in many cases, U.S. Pat. No. 3,303,088 for example, has not been taken into consideration.

U.S. Pat. No. 5,753,075 relates to pumping from a steaming vessel to a processing vessel. U.S. Pat. No. 6,106,668 relates specifically to the addition of AQ/PS during pumping. U.S. Pat. No. 6,325,890 relates to at least two pumps in series and the arrangement of these pumps at ground level.

U.S. Pat. No. 6,336,993 relates to a detail solution where chemicals are added to dissolve metals from the wood chips and then drawing off liquor after each pump to reduce the metal content of the pumped chips.

U.S. Pat. No. 6,551,462 essentially relates to the same system already disclosed in U.S. Pat. No. 3,303,088.

A big disadvantage with the systems with multiple pumps in series is limited accessibility. If one pump breaks down, the whole digester system stops. With 3 pumps in series and normal accessibility for each pump of 0.95, the total systems accessibility is just 0.86 (0.95*0.95*0.95=0.86).

Today's modern continuous digester houses with capacities over 4000 ton pulp per day use digesters that are 50-75 meters high and where a gauge pressure of 3-8 bar is established in the top of the digester in the case of a steam phase digester or 5-20 bar in the case of a hydraulic digester. The continuous digester systems are designed to, during the main part of operation, typically well over 80-95% of operation, run at nominal production, which makes it necessary, in regard to operational costs, for the pumps to be optimized for nominal production.

A typical digester system with a capacity of about 3000 tons with a feed system with so called "TurboFeed™" technology requires about 800 kW of pump power. It is obvious that these systems must have pumps that run at an optimized efficiency close to their nominal capacity. Such a feed system requires 19,200 kWh (800*24) per 24 hours, and at a price of 50 Euro per MWh, the operational cost comes to 960 Euro per 24 hours or 336,000 Euro per year.

The systems must also be able to guarantee operation within 50-110% of nominal production, which places great demands on the feed system.

This means that a system supplier must offer pumps that are large enough to be able to handle 4000 tons, and at the same time be able to be operated within a 2000-4400 ton interval. Such a pump operated at 50% of its capacity is far from optimised, but it is necessary to at least temporarily be able to operate the pump at limited capacity in case of temporary capacity problems, for example further down the fibre line.

If this system supplier offers digester systems that can handle nominal capacities of 500-5000 tons, then the pumps must be designed in a number of different pump sizes so that each individual installation can offer, from a power and energy perspective, optimised transfer at nominal production. This makes the pumps very expensive, as normally a very limited series of pumps are manufactured in each size. To be able to meet demands of reasonably short delivery times, the system supplier must stock pumps in all pump sizes, which is very expensive.

The digester feed should also be able to guarantee optimal feeding to the top of the digester even if the flow in the transfer line is reduced to 50% of nominal flow.

This is difficult, because the flow rate in the transfer lines should be maintained above a critical level, as well-steamed chips have a tendency to sink against the direction of the transfer flow if the speed becomes too low.

A corrective measure that can be used at low rates is to increase the dilution before pumping so that a lower chip concentration is established. This is however not energy efficient as it forces the feed systems to pump unnecessarily high volumes of fluid which increases the pump energy consumption per produced unit of pulp.

Each pump has a construction point (Best Efficiency Point/ "BEP") at which the pump is intended to work. At this "BEP", shock induced loss and frictional loss are, in the case of centrifugal pumps, at their lowest which in turn leads to that the pumps efficiency is highest at this point.

A first object of the present invention is to provide an improved feed system for wood chips wherein optimal transfer can be achieved within a broader interval around the digesters design capacity.

Other objects of the present invention are;

- improved efficiency of the feed system;
- improved accessibility;
- lower operational costs per pumped unit of chips;
- constant chip concentration during pumping regardless of production level;
- a limited range of pump sizes that can cover a broad span of the digester's production capacity;
- simplified maintenance;
- lower installation costs compared to feed systems with high-pressure pocket feeders or multiple pumps in series;

The above mentioned aims may be achieved with a feed system according to the present invention.

DETAILED DESCRIPTION OF THE INVENTION

Figure 1:
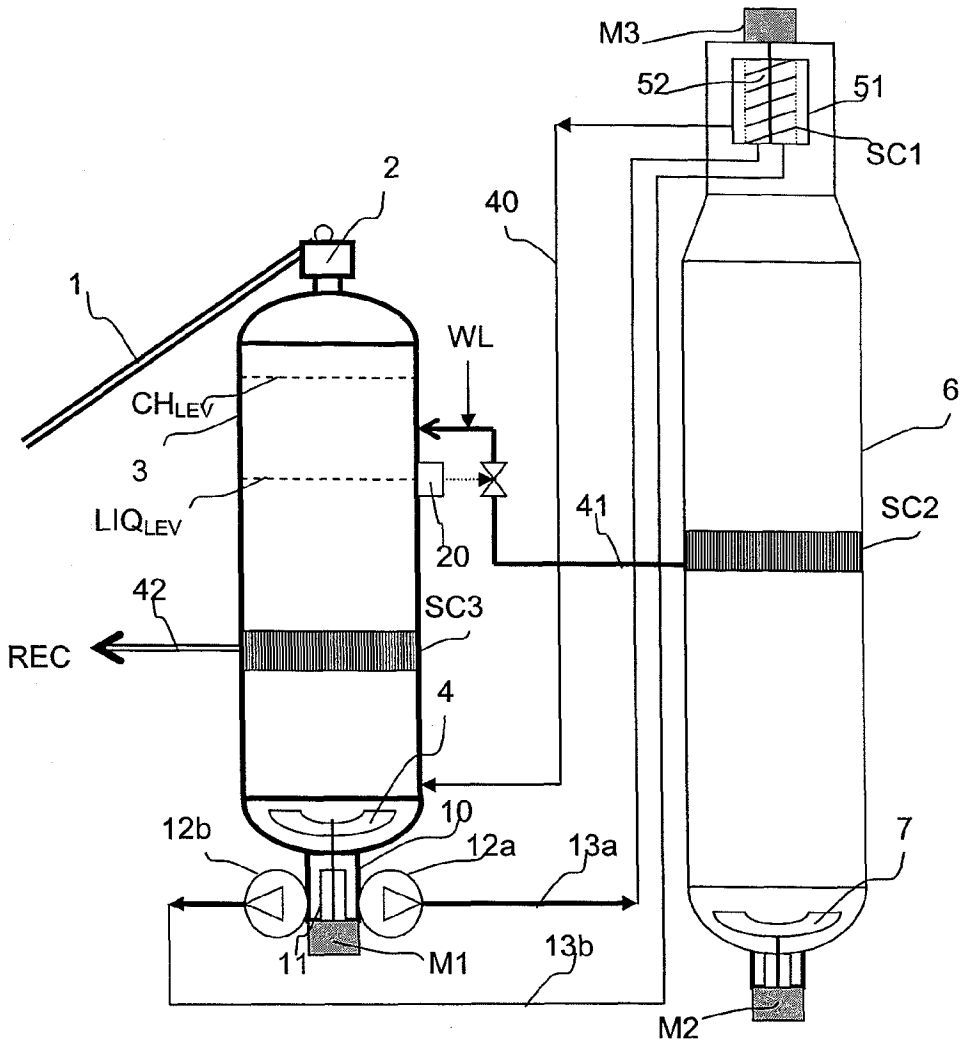
FIG. 1 shows a first system solution for feed systems for digesters with a top separator.

In the following detailed description, the phrase "feed system for a continuous digester" will be used. "Feed system" herein means a system that feeds wood chips from a low pressure chips processing system, typically with a gauge pressure under 2 bar and normally atmospheric, to a digester where the chips are under high pressure, typically between 3-8 bar in the case of a steam phase digester or 5-20 bar in the case of a hydraulic digester.

The term "continuous digester" herein means either a steam phase digester or a hydraulic digester even though the preferred embodiments are exemplified with steam phase digesters.

A basic concept is that a feed system comprises at least 2 pumps in parallel, but preferably even 3, 4 or 5 pumps in parallel. It has been shown that a single pump can feed a chips suspension to a pressurised digester and it is therefore possible to exclude conventional high-pressure pocket feeders or complicated feed systems with 2-4 pumps in series.

The pumps are arranged in a conventional way on the foundation at ground level to facilitate service.

With the above outlined solution it is possible to provide feed systems for digester production capacities from 750 to 6000 tons of pulp per day, with only a few pump sizes. This is very important, as these pumps for feeding wood chips at relatively high concentration are very specific in regard to their applications, and pumps that are able to handle production capacities of 4000-6000 tons of pulp per day are very large and only manufactured in very limited series of a few pumps per year. The cost for these pumps therefore makes up a large part of the total cost of running a digester system.

The table below shows an example of how it is possible to cover a production interval from 750-6000 tons with only two pump sizes optimised for 750 and 1500 tons of pulp, respectively, per day;

PUMP PROGRAM (X units* = 1:st alternative)

| Nominal Production Capacity (ton per day) | 750 pump | 1500 pump |
|---|---|---|
| 750 | 1 unit | |
| 1500 | 2 units | |
| 2250 | 1 unit | 1 unit |
| (2250 alt) | (3 units*) | — |
| 3000 | — | 2 units |
| (3000 alt) | (4 units*) | |
| 3750 | 1 unit | 2 units |
| 4500 | — | 3 units |
| (4500 alt) | (2 units*) | (2 units*) |
| 5250 | 1 unit | 3 units |
| 6000 | | 4 units |

This table clearly shows how it is possible, with the concept according to the present invention, to cover production capacities between 1500-6000 tons with only 2 optimised pump sizes while using a single pump installation in smaller digester systems with a capacity below 750 tons. Continuous digesters with a capacity of 750 tons are seldom used in new installations of digester systems today, because batch digester systems are often more competitive for these capacities. A certain after-market may exist for older digester systems with a low capacity where expensive feed systems with high-pressure pocket feeders are still used.

First Embodiment

FIG. 1 shows an embodiment of the feed system with at least 2 pumps in parallel. The chips are fed with a conveyor belt 1 to a chips buffer 2 arranged on top of an atmospheric treatment vessel 3. In this vessel, a lowest liquid level, $LIQ_{LEV}$, is established by adding an alkali impregnation liquid, preferably cooking liquor (black liquor) that has been drawn off in a strainer screen SC2 in a subsequent digester 6, and with a possible addition of white liquor and/or another alkali filtrate.

The chips are fed with a normal control of the chip level $CH_{LEV}$ which is established above the liquid level $LIQ_{LEV}$.

The remaining alkali content in the black liquor is typically between 8-20 g/l. The amount of black liquor and other alkali liquids that are added to the treatment vessel 3 is regulated with a level transmitter 20 that controls at least one of the flow valves in lines 40/41. With this alkali impregnation liquor the wood acidity in the chips may be neutralised and impregnated with sulphide rich ($HS^-$) fluid. Spent impregnation liquor, with a remaining alkali content of about 2-5 g/l, preferably 5-8 g/l, is drawn off from the treatment vessel 3 via the withdrawal strainer SC3 and sent to recovery REC. If necessary, white liquor WL may also be added to the vessel 3, for example as shown in the figure to line 41. The actual remaining alkali content depends on the type of wood used, softwood of hardwood, and which alkali profile that is to be established in the digester.

In the case where a raw wood material that is easy to impregnate and neutralise is used, for example raw wood material such as pin chips or wood chips with very thin dimensions and a quick impregnation time, vessel 3 may in extreme cases be a simple spout with a diameter essentially corresponding to the bucket formed outlet 10 in the bottom of the vessel. Required retention time in the vessel is determined by the time it takes for the wood to become so well impregnated that it sinks in free cooking liquor.

After the chips have been processed in vessel 3 they are fed out from the bottom of the vessel where also a conventional bottom scraper 4 is arranged, driven by a motor M1.

According to the invention, the chips are fed into the digester via at least 2 pumps 12*a*, 12*b* in parallel, and these pumps are connected to a bucket formed outlet 10 in the bottom of the vessel. The bucket formed outlet 10 has an upper inlet, a cylindrical mantle surface and a bottom. The pumps are connected to the cylindrical mantle surface.

To facilitate pumping of the chip mixture, the chips are suspended in a vessel 3 to create a chips suspension, in which vessel is arranged a fluid supply via lines 40/41, controlled by a level transmitter 20 that establishes a liquid level $LIQ_{LEV}$ in the vessel above the pump level by at least 20 meters. Hereby, a high static pressure is established in the inlet to pumps 12*a* and 12*b*, so that one single pump can pressurise and transfer the chips suspension to the top of the digester without cavitation of the pump. The top of the digester is typically arranged at least 50 meters above the level of the pump, usually 60-75 meters above the level of the pump, while a pressure of 5-10 bar is established in the top of the digester.

To further facilitate the feeding to the pumps, a stirrer 11 is arranged in the bucket formed outlet. The stirrer 11 is preferably arranged on the same shaft as the bottom scraper and driven by the motor M1. The stirrer has at least 2 scraping arms that sweep over the pump outlets arranged in the bucket formed outlet's mantle surface. Preferably a dilution is arranged in the bucket formed outlet, which may be accomplished by dilution outlets (not shown) connected to the upper edge of the mantle surface.

FIGS. 3-6 show how a number of pumps 12*a*-12*d* may be connected to the outlet's cylindrical mantle surface and how the stirrer 11 may be fitted with up to 4 scraping arms. The pumps may preferably be arranged symmetrically around the outlet's cylindrical mantle surface with a distribution in the horizontal plane of 90° between each outlet if there are 4 pump connections (120° if there are 3 pump connections and 180° if there are 2 pump connections). This way it is possible to avoid an uneven distribution of the load on the bottom of the vessel and its foundation. In practice, shut-off valves (not shown) are also arranged between the outlet's 10 mantle surface and the pump inlet and a valve directly after the pump to make it possible to shut off the flow through one pump if this pump is to be replaced during continued operation of the remaining pumps.

In FIG. 1 the chips are fed by pumps 12*a*, 12*b* via transfer lines 13*a*, 13*b* (only two shown in FIG. 1) to the top of the digester 6. FIG. 1 shows a conventional top separator 51 arranged in the top of the digester. The transfer lines 13*a*, 13*b*, preferably 2, both open into the bottom of the top separator, where, driven by motor M3, a feeding screw 52 drives the chips slurry up under a dewatering process against the top separator's withdrawal strainer SC1. Drained chips will then be fed out from the upper outlet of the separator in a conventional way and fall down into the digester. In the case a hydraulic digester is used, the top separator is turned up-side down and feeds the chips down into the digester.

The drained liquid from the top separator 51, is led through a line 40 back to the processing vessel 3, and may preferably be added to the bottom of the processing vessel, to there facilitate feeding out under dilution.

Alternatively, line 40 may be connected to the position for the outlet of line 41 in the processing vessel 3 and line 41 may be connected to the position for the outlet of line 40 in the processing vessel 3, according to the concept CrossCirc™ marketed by Metso Paper. In a variation, the flow of line 40 and 41 may be mixed in the intersection of lines 40 and 41 in FIG. 1.

The digester 6 may be fitted with a number of digester circulations and with addition of white liquor to the top of the digester or to the digester's supply flows (not shown). The Figure shows a withdrawal of cooking liquor via strainer SC2. The cooking liquor drawn off from strainer SC2 is known as black liquor and may have a somewhat higher content of remaining alkali than black liquor that is normally sent directly to recovery and normally drawn off further down in the digester. The cooked chips P are then fed out from the bottom of the digester with the help of a conventional bottom scraper 7 and the cooking pressure.

Second Embodiment

Figure 2:
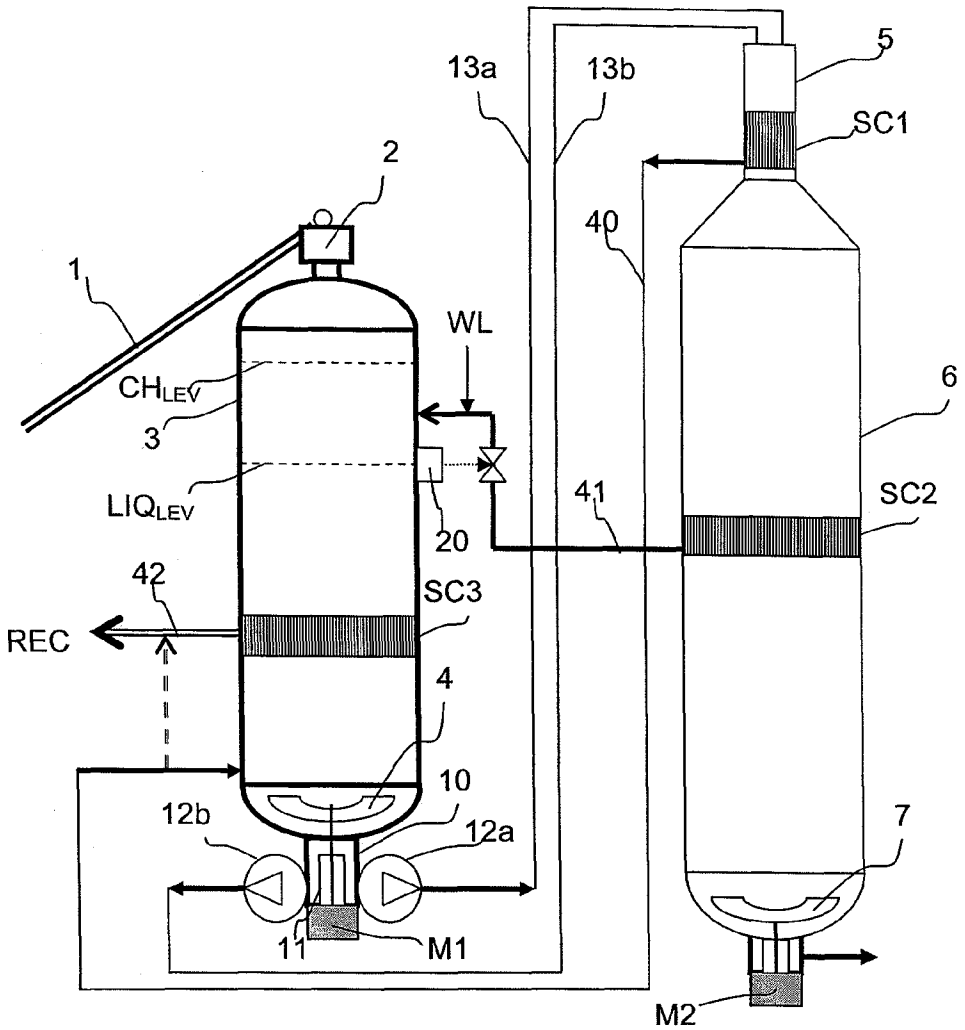
FIG. 2 shows a second system solution for feed systems for digesters without a top separator.
Figure 3:
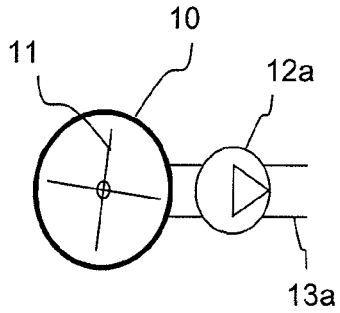
FIGS. 3-6 show different ways of attaching pumps to an outlet in a pre-treatment vessel.
Figure 4:
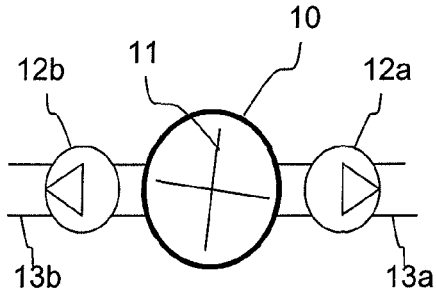
Figure 5:
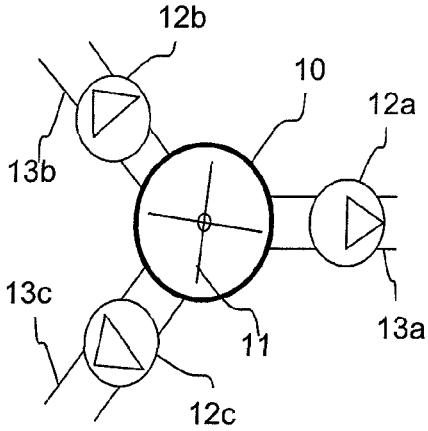
Figure 6:
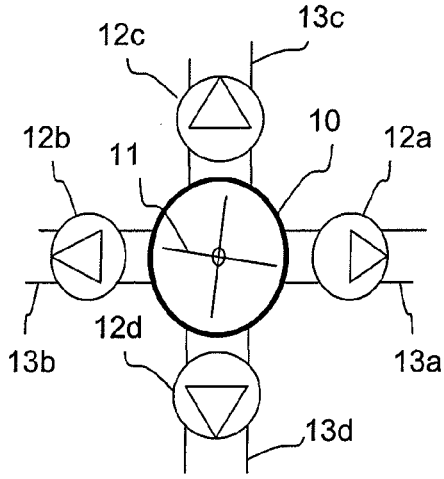
Figure 7:
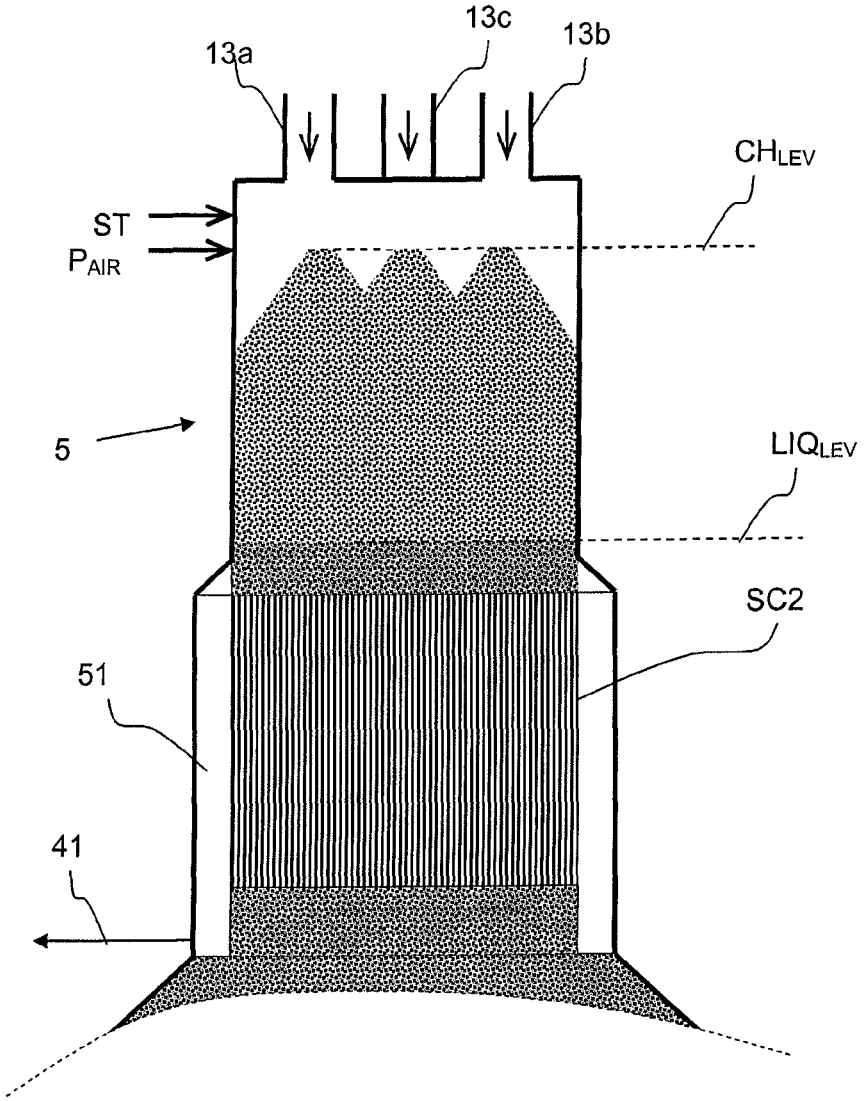
FIG. 7 shows the feed system's connection to the top of a digester without a top separator.
Figure 8:
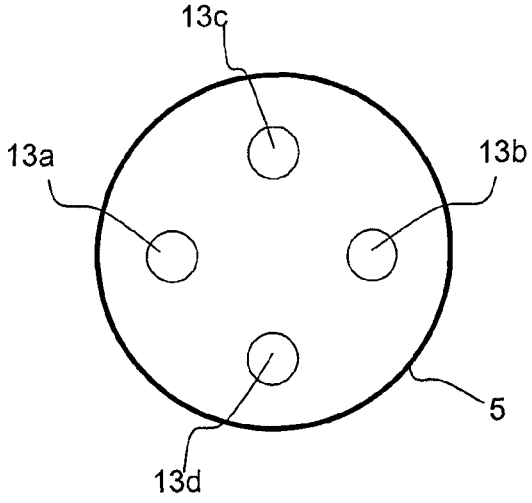
FIG. 8 shows a top view of FIG. 7.

FIG. 2 shows an alternative embodiment which does not include a top separator. Instead the transfer lines 13*a*, 13*b* (only two are shown in FIG. 1) open directly into the top of the digester. Excess liquid is then drawn off with a digester strainer SC1 arranged in the digester wall. FIGS. 7 and 8 show this in more detail. The remaining parts of this embodiment correspond to the digester system shown in FIG. 1.

FIG. 8 shows how 4 transfer lines 13*a*, 13*b*, 13*c* and 13*d* may open directly into the top of the digester. These outlets may preferably be arranged symmetrically in the top of the digester with a distribution in the horizontal plane of 90° between each outlet if there are 4 outlets (120° if there are 3 outlets and 180° if there are 2 outlets). The outlets are suitably arranged at a distance of 60-80% of the digester radius. FIG. 7 shows how the transfer lines 13*a*, 13*b* and 13*c* open directly down into the top of the digester and thereby distribute the chips over the cross-section of the digester. In this case a steam phase digester is shown, where steam ST and/or pressurised air $P_{AIR}$ is added to the top of the digester, in which a chips level $CH_{LEV}$ is established above the liquid level $LIQ_{LEV}$ in the top of the digester. Excess liquid is drawn off with a strainer SC2 and collected in a withdrawal space 51 before being led back via line 41. An advantage with the second embodiment, but also with the first embodiment, is that each pump may be closed independently while the remaining pumps may continue pumping at optimal efficiency and without requiring modification of the feed system itself.

Third Embodiment

Figure 9:
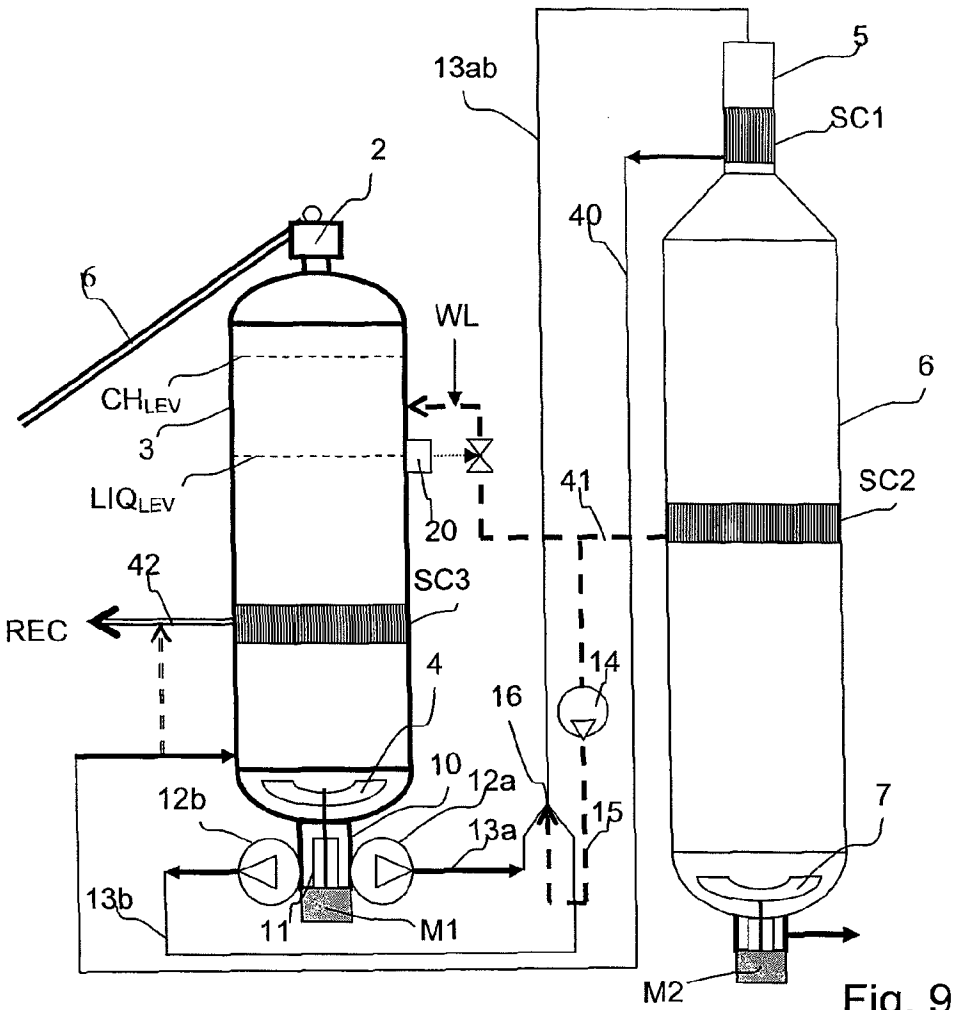
FIG. 9 shows a third system solution for feed systems for digesters without a top separator.

FIG. 9 shows an alternative embodiment for the feed system to a continuous digester without a top separator where each pump 12*a*, 12*b* pushes the chips suspension through a first section 13*a*, 13*b* of a transfer line to the top of the digester, and the first sections of the transfer lines from at least 2 pumps are combined at a merging point 16 to form a combined second section 13*ab* of the transfer line before this second section is led towards the top of the digester. To maintain a constant flow rate, a supply line 15 is also connected to the merging point 16. In this embodiment, black liquor is taken from line 41 and may be pressurised with a pump 14. However, because the black liquor has already reached a full digester pressure, the need to pressurise the liquor is limited. All other characterizing parts of the system correspond to the system shown in FIG. 2.

Fourth Embodiment

Figure 10:
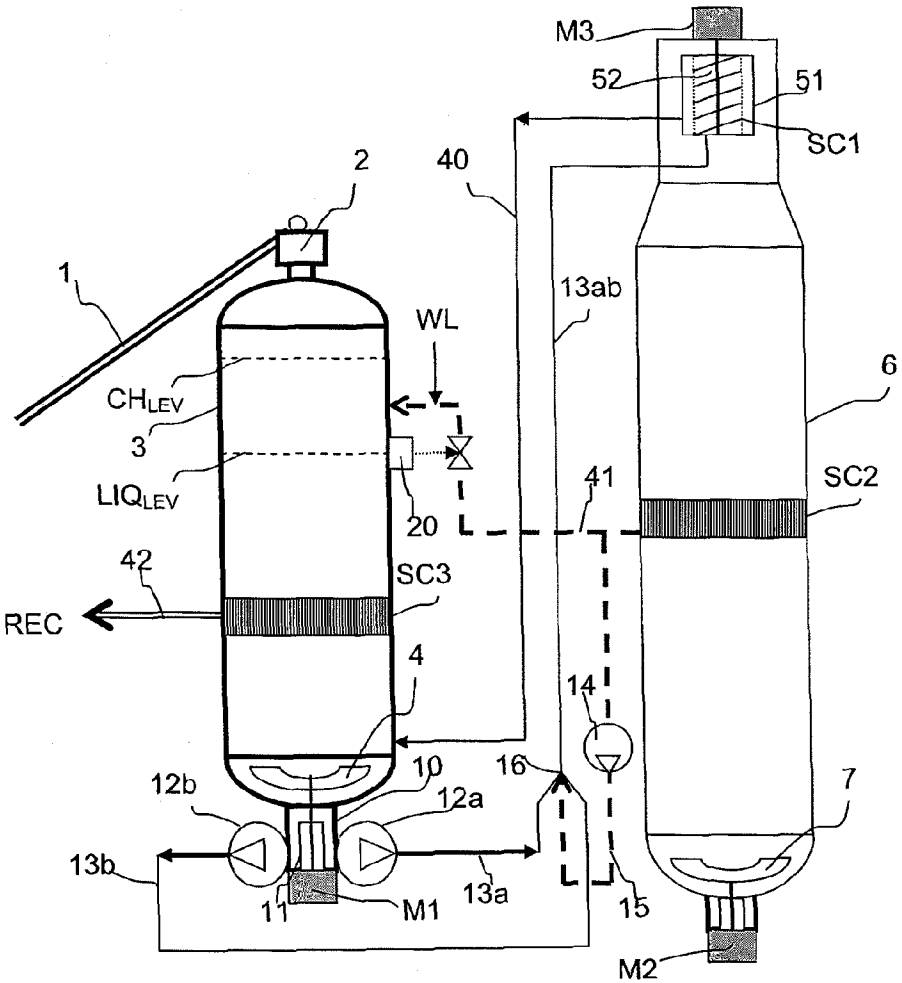
FIG. 10 shows a fourth system solution for feed systems for digesters with a top separator.

FIG. 10 shows an alternative embodiment of the feed system for a continuous digester with a top separator where each pump 12*a*, 12*b* pushes the chips suspension through a first section 13*a*, 13*b* of a transfer line to the top of the digester, and the first sections of the transfer lines from at least 2 pumps are combined at a merging point 16 to form a combined second section 13*ab* of the transfer line before this second section is led towards the top of the digester. To maintain a constant flow rate, a supply line 15 is also connected to the merging point 16. In this embodiment, black liquor is taken from line 40 and may be pressurised with a pump 14. However, because the black liquor has already reached a full digester pressure, the need to pressurise the liquor is limited.

All other characterizing parts of the system correspond to the system shown in FIG. 1.

Figure 11:
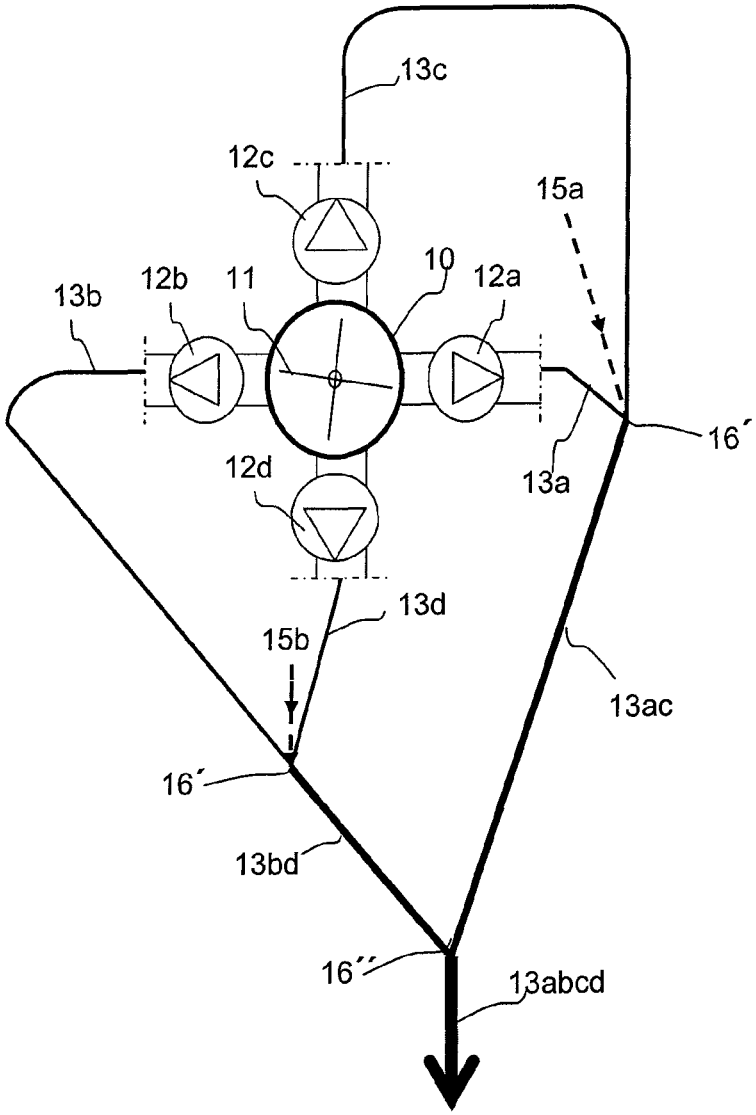
FIG. 11 shows how the transfer lines from each pump in the systems in FIGS. 9 and 10 may be combined into one single transfer line.

FIG. 11 shows an example of how supply lines 15*a*, 15*b* that are used in both the third and the fourth embodiment may be connected to merging points 16' in the case 4 pumps 12*a*-12*d* are used. An advantage with this supply arrangement is that it is possible to guarantee optimal speed in the combined flow in the second section 13*ac*/13*bd* and in the combined flow in the final third section 13*abcd* of the transfer line.

It is critical that the rate of the flow up to the digester is well over 1.5-2 m/s so that the chips in the flow do not sink down towards the feed flow and cause plugging of the transfer line. The flow in the transfer line should suitably be maintained at between 4-7 m/s to make sure that the chips are transferred to the top of the digester.

If, for example, pump 12*a* would be shut down due to repair or a desired capacity reduction, the flow in supply line 15*a* may be increased so that the flow rate in the second section 13*ac* is maintained.

In these combined line systems for the transfer of chips suspensions it is advantageous that the lines after the merging points 16, 16', 16" have a flow cross-section that is equal to or greater than the sum of the incoming lines, to avoid pressure loss in the transfer lines. Suitable equations for flow areas A may be:

$$A_{13bd} \geq (A_{13d} + A_{13b}), \text{ and}$$

$$A_{13abcd} \geq (A_{13bd} + A_{13ac}).$$

In a transfer line where the first section has a diameter of for example 100 mm and an established flow rate of 5 m/s, a flow rate of 4.4 m/s is established if a second section that combines 2 lines with diameter 100 mm has a diameter of 150 mm. With a subsequent combination of 2 such lines with a diameter of 150 mm to a third section with a diameter of 250 mm, a flow rate of 3.18 m/s may be established. All these flow rates have a wide margin toward the critical lowest flow rate.

The supply lines 15*a*, 15*b* may also have connections directly after each pump outlet, so that the line between pump and merging point is kept flushed during the time that the pump is shut down or operated at a reduced capacity. The addition of extra fluid may also be combined with a further dilution of the chips suspension before the pumps, for example on the suction side of the pumps or in the bottom of vessel 3.

Figure 12:
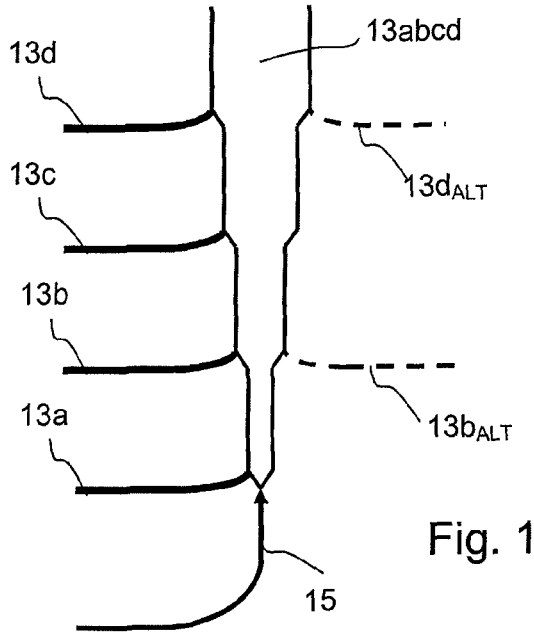
FIG. 12 shows a second alternative of how the transfer lines from each pump may be combined into one single transfer line.

FIG. 12 shows a cross-sectional view of a second embodiment of how lines 13*a*-13*d* from the pumps may be combined to one single transfer line 13*abcd*. Here, the supply line 15 for dilution liquid provides a vertical part of the transfer line towards the top of the digester, and each line 13*a*, 13*b*, 13*c*, 13*d* from each pump is connected successively, one by one, to this vertical part of the transfer line at different heights. At each supply position, the chips flow is added in a conical part of a diameter increase in the transfer line. As is indicated by the dashed alternatives $13b_{ALT}$/$13d_{ALT}$, the connections from the pumps may instead be shifted from side to side on the transfer line.

Figure 13:
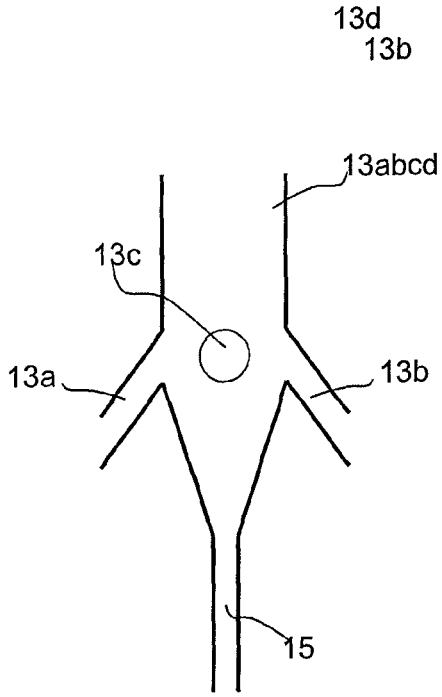
FIG. 13 shows a third alternative of how the transfer lines from each pump may be combined into one single transfer line.

FIG. 13 shows a cross-sectional view of a third embodiment of how lines 13*a*-13*d* from the pumps may be combined to one single transfer line 13*abcd*. Here, the supply line 15 for dilution liquid provides a vertical part of the transfer line towards the top of the digester, and each line 13*a*, 13*b*, 13*c*, 13*d* from each pump is connected at the same height to this vertical part of the transfer line. Preferably the supply position for the chips flow is arranged in a conical part of a diameter increase in the transfer line and each connected line is oriented upwards and inclined at an angle in relation to the vertical orientation in the interval 20-70 degrees. The figure shows only the connections 13*a*, 13*b*, 13 *c*, as connection 13*d* is in the part that is cut away in this view.

The invention is not limited to the above mentioned embodiments. More variations are possible within the scope of the following claims.

In the embodiments shown in FIGS. 2 and 9, in some applications the strainer SC1 and the return line 40 may for example be omitted, preferably for cooking of wood material with a higher bulk density, such as hardwood (HW), that for a corresponding production volume require less liquid during transfer.

In the case where a raw wood material that is easy to impregnate and neutralise is used, for example raw wood material such as pin chips or wood chips with very thin dimensions and a quick impregnation time, vessel 3 may in extreme cases be a simple spout with a diameter essentially corresponding to the bucket formed outlet 10 in the bottom of the vessel.

If the chips fed into the vessel 3 are already well steamed, the liquid level $LIQ_{LEV}$ may be established above a chips level $CH_{LEV}$.

In the embodiments shown, an alkali pre-treatment was used in vessel 3, but it is also possible to use a process where this pre-treatment comprises acid pre-hydrolysis.

There is a substantial difference between pumping chips suspensions/slurries compared to pumping water-like liquids. In general, handbooks in pumping provide advice and instructions for pumping water-like fluids. However, the special circumstances of pumping slurries with a high content of solid matter must always be given special attention.

One difference, when pumping chip slurries, is that chips suspensions establish a volume of interlocked chips that create a flow-restriction, or a pressure drop through the chips, of the free liquid in the chips suspension/slurry through the slurrying vessel. It cannot, therefore, be assumed that a liquid head has the same impact upon the pumping inlets as in any general application where pumps are pumping pure liquid and the hydraulic system/volume transmits a full hydraulic pressure as a result of the liquid volume disposed above the pump inlets.

Another difference is that the chips in the chips suspension interlock, or have a tendency to interlock, to one another that creates a unitary interlocked volume of chips that moves as one "plug" flow. This unitary flow does not behave like a conventional liquid-like liquids do. It is difficult to break up the unitary plug-flow of interlocked chips into several partial flows which would require that the chip-plug flow behaves more like a liquid feeding each pump inlet with equal feeding volume tapped off from the chip plug flow.

When a hot liquid is added to a flow of chips suspension containing interlocked chips, such as adding hot black liquor via a pipe, it was surprisingly discovered that the hot liquid does not mix well or thoroughly with the chips suspension because hot streaks of black liquor was discovered in the transfer lines all the way up to the digester. It was also surprisingly discovered that the hot streaks of black liquor do not shift from one side to another inside the transfer line either but remained stable in the same position inside the transfer line.

It was also surprisingly discovered that by breaking up the chips plug, by using scraping arms of a stirrer close to the outlets at the pump inlets, the interlocking effect between chips in the chips suspension is sufficiently broken up by continuous agitation from the stirrer so the feed of the chips slurry is unrestricted towards all the pump inlets which is important when many pump inlets are used because the distribution of the flow to the various pump inlets is more even. It was also surprisingly discovered that because the chips suspension/slurry is sufficiently broken up by continuous agitation from the stirrer, the raising of the liquid level above the pump inlet aids the pumping even when many pumps in parallel are connected to the vessel outlet. The breaking up of the interlocked chips also enhances the mixing of the hot liquor into the chips suspension which in turn reduces the hot streaks described above.

More particularly, the pressure of the liquid head, as a result of the liquid level being 20 meters above the pump inlets, positively affects the pumping of the chips slurry from the multiple outlets of the vessel up to the top of the digester even if only one single pump per transfer line is used for the entire pump head. If the plug flows are not broken up, there is a high risk of pump cavitation due to the interlocking of the chips in each pump inlet and uneven flow between the pump inlets, as all multiple pump inlets establish a negative pressure in the pump inlets and hence into the bottom of the tower increasing the risk for cavitation in pumps.

It may not be expected that an increased liquid head in the chip slurry should have a positive impact on reducing cavitation especially if multiple pumps are connected to the bottom of the tower, as the chip pile may reduce the hydraulic head by the flow restrictions through the chip pile. It is should noted that an increased head of the chip slurry above the pump inlets also imposes an increase in chip compaction, due to the weight of material, and thus an increased liquid flow restriction through the chip pile.

In other words, when the chips in the chips slurry are interlocked, the static pressure at the bottom of the vessel does not generally change as linearly as it does in hydraulic systems by raising the liquid level as the liquid head experiences a pressure drop through the interlocked chip pile. Especially, if multiple single pumps, i.e. one single pump per transfer line, wherein the pumps are in parallel, are connected to the bottom of the vessel, all pumps induce a super-imposed negative pressure from each pump inlet that may cause cavitation.

However, it was surprisingly discovered that the static pressure, by having the liquid level 20 meters above the pumps, created by the stirrer breaking up the interlocked chip plug in the chips suspension at the bottom of the vessel is high enough so that a single pump per transfer line can pump the chips slurry to the top of the digester kept at full digester pressure without cavitation of the pump (due to lack of sufficient or uneven feed of the chips slurry to each pump inlet). The breaking up of the interlocked chips makes the flow characteristics of the chips suspension to be more similar to that of the flow characteristics of conventional or water-like liquids.

While the present invention has been described in accordance with preferred compositions and embodiments, it is to be understood that certain substitutions and alterations may be made thereto without departing from the spirit and scope of the following claims.

We claim:

1. A method for feeding wood chips to a continuous digester, comprising, feeding wood chips into a vessel having a rotatable stirrer at a bottom of the vessel, the vessel having a bucket-shaped outlet, suspending the wood chips in the vessel to create a chips suspension;

establishing a liquid level (LIQLEV) of at least 20 meters above a pump level of at least two pumps, arranging the at least two pumps in parallel connected directly to the bottom of the vessel, the two pumps having no pump serially connected thereto upstream or downstream thereof, the stirrer having two scraper arms sweeping over pump inlets arranged in the bucket-shaped outlet, each pump transferring the chips suspension in a transfer line extending from the vessel to the top of a digester, cooking the wood chips in the digester to form a pulp, and continuously feeding out pulp from a bottom of the digester.

2. The method for feeding wood chips according to claim 1 wherein at least three pumps transfer the chips suspension to the top of the digester.

3. The method for feeding wood chips according to claim 2 wherein at least four pumps transfer the chips suspension to the top of the digester.

4. The method for feeding wood chips according to claim 2 wherein the method further comprises connecting the pumps circumferentially, symmetrically and in a horizontal plane to the bottom of the vessel.

5. The method for feeding wood chips according to claim 2 wherein each transfer line is provided with an outlet opening that opens directly into the top of the digester so that the chips suspension fall into the digester.

6. The method for feeding wood chips according to claim 2 wherein the method further comprises providing the vessel with a bucket-shaped outlet that has an upper inlet, a cylindrical mantle surface and a bottom, the cylindrical mantle surface having two outlets defined therein, connecting pump inlets of the pumps to the outlets of the cylindrical mantle surface, connecting pump outlets of the pumps to the transfer lines.

7. The method for feeding wood chips according to claim 2 wherein each pump transfer the chips suspension in a first section of the transfer lines extending to the top of the digester, the first section of the transfer lines merging at a merging point to form a combined second section extending to the top of the digester.

* * * * *